United States Patent [19]

Fluck

[11] 4,354,589

[45] Oct. 19, 1982

[54] METHOD AND APPARATUS FOR GROUPING FLAT ITEMS IN STACKS

[75] Inventor: René Fluck, Schleitheim, Switzerland

[73] Assignee: SIG Schweizerische Industrie-Gesellschaft, Neuhausen, Switzerland

[21] Appl. No.: 209,329

[22] Filed: Nov. 21, 1980

[30] Foreign Application Priority Data

Nov. 23, 1979 [CH] Switzerland ..... 10463/79

[51] Int. Cl.[3] ..... B65G 59/06

[52] U.S. Cl. ..... 198/419; 53/240; 53/493; 53/534; 198/421; 221/14; 414/104

[58] Field of Search ..... 198/419, 420, 421; 414/41, 104; 53/240, 251, 493, 494, 534; 221/14, 93, 95

[56] References Cited

U.S. PATENT DOCUMENTS

| | | | |
|---|---|---|---|
| 3,338,370 | 8/1967 | Maulini | 198/421 |
| 3,820,649 | 6/1974 | Fluck | 198/421 |

FOREIGN PATENT DOCUMENTS

| | | |
|---|---|---|
| 528431 | 11/1972 | Switzerland . |
| 898188 | 6/1962 | United Kingdom . |
| 1045225 | 10/1966 | United Kingdom . |
| 1366826 | 9/1974 | United Kingdom . |

*Primary Examiner*—Jeffrey V. Nase
*Attorney, Agent, or Firm*—Spencer & Kaye

[57] ABSTRACT

A method and an apparatus for grouping flat items in stacks, particularly cookies which are advanced to a grouping device in at least three mutually parallel channels. The grouping device forms mixed groups of the items such that each group contains at least one item taken from each channel. For the purpose of compensating for an undersupply of items in at least one channel, the quantity of items which is normally taken from such an undersupplied channel is decreased by a first quantity and the quantity of items which is normally taken from the other, normally supplied channels is increased by a second quantity such that as the cadenced removal of items from the channels progresses, the number of items in the obtained mixed groups remains constant.

7 Claims, 16 Drawing Figures

Fig.11A
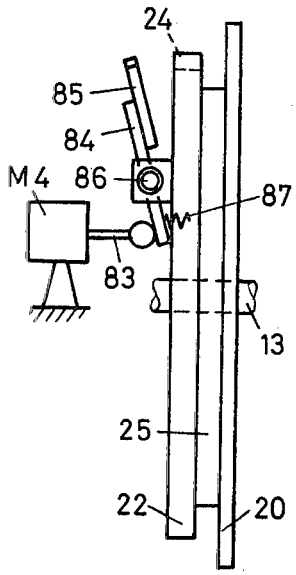
Fig.12
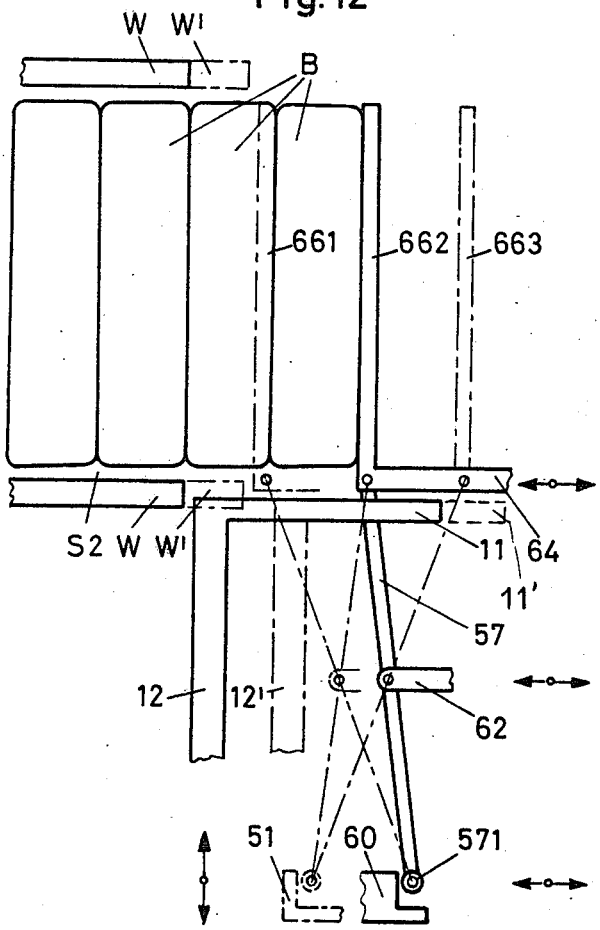
Fig.11B
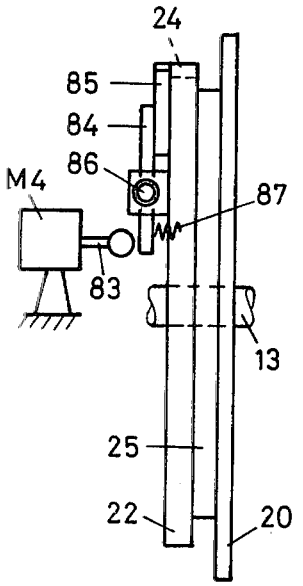
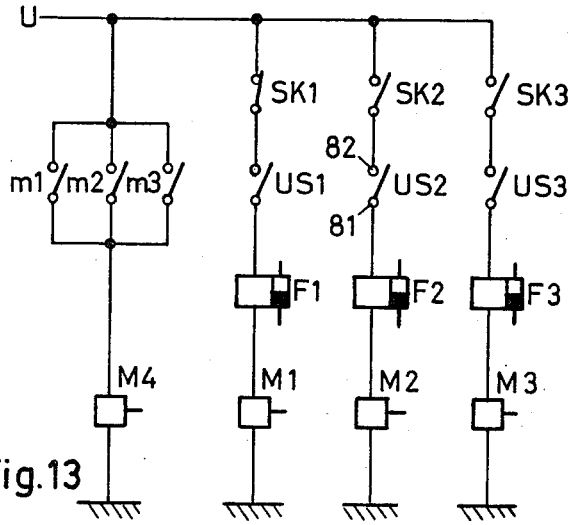
Fig.13

METHOD AND APPARATUS FOR GROUPING FLAT ITEMS IN STACKS

BACKGROUND OF THE INVENTION

This invention relates to a method and an apparatus for grouping flat items in stacks, particularly cookies which are advanced to a grouping device in at least three mutually parallel channels. The grouping device forms mixed groups of the items such that each group contains at least one item taken from each channel.

Known arrangements for stacking flat, generally disc-shaped articles, such as cookies which are fed in parallel channels to a grouping device comprise a chute associated with each channel. The bottom of each chute is formed by a lowering finger and a reciprocating ejecting finger. The lowering finger can be vertically adjusted whereby the number of the items in the channels may be varied to ensure that each mixed group will contain an item from each channel.

The above-outlined group mixing is preferred because it is well known that cookies discharged from different locations of the baking oven have usually different thicknesses and therefore, in order to achieve packages of uniform size, the items arriving in the different channels should be mixed in each group so that each group will have the same number of items and further, each group will contain at least one item from each channel.

By virtue of the fact that the lowering fingers can be adjusted by means of a common setting member in at least two height positions, the number of items in each mixed group may be varied between wide limits.

In systems of the above-outlined type it is feasible to determine an undersupply (shortage) in any individual channel; that is, in at least one channel there may be locations which have an insufficient number of items for loading the discharge mechanism with the required number of items predetermined for the grouping device. As a result, mixed groups are obtained which do not have enough items.

In order to avoid such an occurrence, the channels are manually resupplied with items. In systems with side-by-side channels which extend over a width of more than 1 meter, two attendants are required to monitor the quantities of the items and to effect the manual resupplying.

SUMMARY OF THE INVENTION

It is an object of the invention to provide an improved method and apparatus of the above-outlined type which ensure an automatic correction of undersupplied channels.

This object and others to become apparent as the specification progresses, are accomplished by the invention according to which, briefly stated, for the purpose of compensating for an undersupply of items in at least one channel, the quantity of items which is normally taken from such an undersupplied channel is decreased by a first quantity and the quantity of items which is normally taken from the other, normally supplied channels is increased by a second quantity such that as the cadenced removal of items from the channels progresses, the number of items in the obtained mixed groups remains constant.

BRIEF DESCRIPTION OF THE DRAWING

FIGS. 11A and 11B are schematic views showing an arrangement of channel control in an undersupplied and a normally supplied state, respectively.

FIG. 12 is a schematic view of lowering and ejecting fingers showing three positions of the lowering fingers in one chute.

FIG. 13 is a circuit diagram for an electric channel control with devices shown in FIGS. 11A and 11B.

DESCRIPTION OF THE PREFERRED EMBODIMENT

Figure 1:
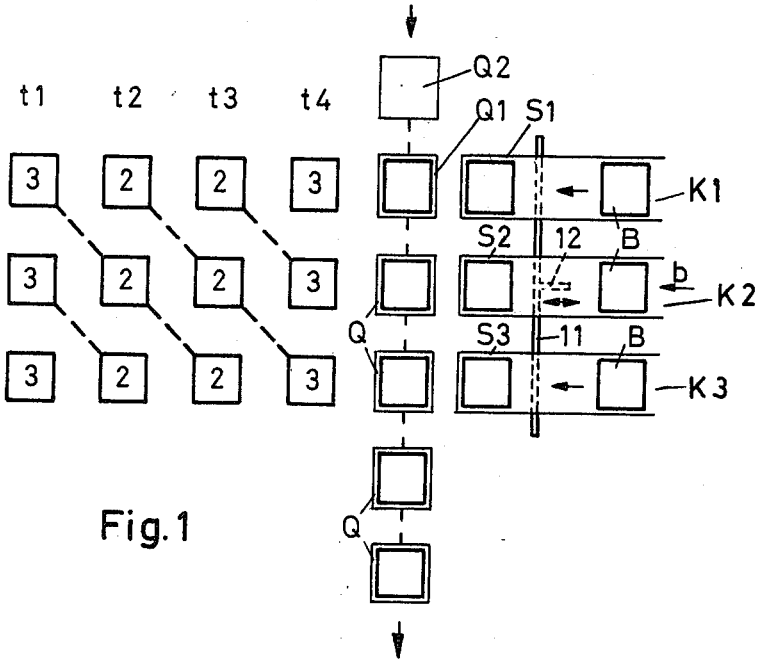
FIG. 1 is a diagrammatic view of the known principle of the group forming in case of normally supplied channels.

The grouping apparatus schematically illustrated in FIG. 1 has three chutes S1, S2 and S3 which are charged with cookies B from respective channels K1, K2 and K3. In these channels the cookies B are conveyed in the direction of the arrow b; they are supplied from a baking oven, not shown. The channels may be formed by inclined tracks or by endless conveyor belts. For forming a group of articles, at least one item is taken from each channel, as will be described below.

Adjacent the chutes S1–S3 there passes an endless conveyor chain which extends transversely to the channels K1–K3. The conveyor chain has spaced item carrying trays (carrier components) designated at Q. It is assumed that the tray Q1 is situated adjacent the chute S1 at time t1. By means of a pusher 11 which is reciprocated by a rod 12, the items situated in the chute S1 are pushed on the tray Q1. At the same time, items are pushed on respective trays also from the chutes S2 and S3. By time t2 the tray Q1 has advanced to the chute S2 and in the charging cadence associated with time t2, items are pushed from the chute S2 to the already present items that were taken from the chute S1. At time t3 the tray Q1 has reached the chute S3 and receives items therefrom.

By time t4 on the conveying member Q1 there are accumulated items from all three chutes S1–S3. At the left-hand side of FIG. 1 the items (cookies) are shown as squares and the numerals in the squares indicate the quantities of the items which, at any given time, are placed on the tray. According to the dash lines, at time t1 there are charged three items from the chute S1, at time t2 there are charged two items from the chute S2 and at time t3 there are charged two items from the chute S3 onto the tray Q1. Thus, by time t3 the tray Q1 carries seven items. From the diagrammatic FIG. 1 the subsequent charging steps for the other trays Q readily follow.

Figure 2A:
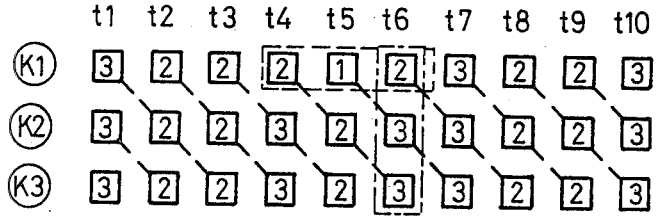
FIGS. 2A, 2B and 2C are diagrammatic illustrations of the principle of group forming in case of an undersupply of a first, second and third channel, respectively, according to the invention.
Figure 2B:
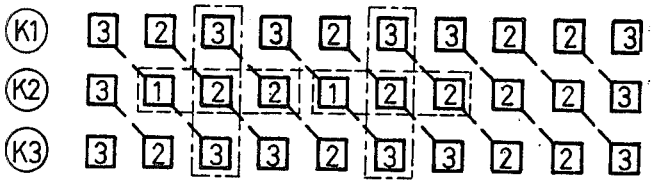
Figure 2C:
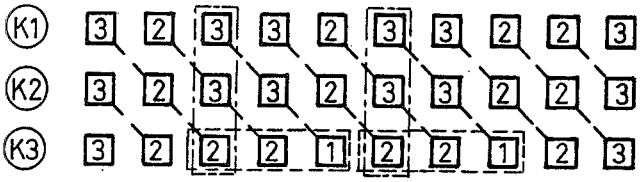

FIGS. 2A through 2C are diagrams similar to that of FIG. 1, except that ten points in time t1–t10 are shown, together with the items introduced from the three channels K1–K3 to the chutes S1–S3 and transferred to the trays of the conveyor chain (not illustrated in FIGS. 2A–2C). It is assumed that in the FIG. 2A arrangement at time t4 in channel K1 there is an undersupply, that is, an insufficient quantity of items. Therefore, according to the invention, from channel K1 instead of the normally available three items, at time t4 only two items are delivered and at the consecutive time t5 only one item is delivered instead of two. In this manner, in the channel K1 there is a gain of two items. In the mixed groups carried on the two consecutive trays, however, there will be a shortage of one item each. The missing item is delivered at time t6 by ensuring that from each of the two channels K2 and K3 one extra item is transferred to the trays; that is, three items instead of two are taken from the channels K2 and K3 (the normal sequence would be 3-2-2 items).

In FIG. 2B it is assumed that at time t2 in the channel K2 an undersupply is determined. In the entire period t2 to t7 there is then taken one item less from channel K2 than from channels K1 and K3. For the purpose of equalization on the trays, at times t3 and t6, from each of channels K1 and K3 there is taken one extra item so that the mixed groups are complemented accordingly.

According to FIG. 2C at time t3 there is determined an undersupply in the channel K3. At times t4, t5 and t7, t8, this channel each time is caused to deliver one item less than the other channels K1 and K2. In contradistinction, at time t3 and t6 from the channels K1 and K2 there is taken an extra item for the trays. Thus, from channel K3 there are taken four items less and in the other two channels there are taken two items more each, so that an equalization of the mixed groups on the trays is rapidly reestablished.

If, as a variant, the mixed group, for example, is to contain only four items, then in the squares of FIGS. 2A-2C the numerals in the squares should be one less. It is thus seen that in such a case the individual mixed groups do not contain any item from the undersupplied channel during this equalization.

An exemplary system of a stacking device with conveying members (carrier trays) as described above for forming a mixed group is disclosed in Swiss Pat. No. 528,431, which is incorporated hereby by reference.

Figure 3:
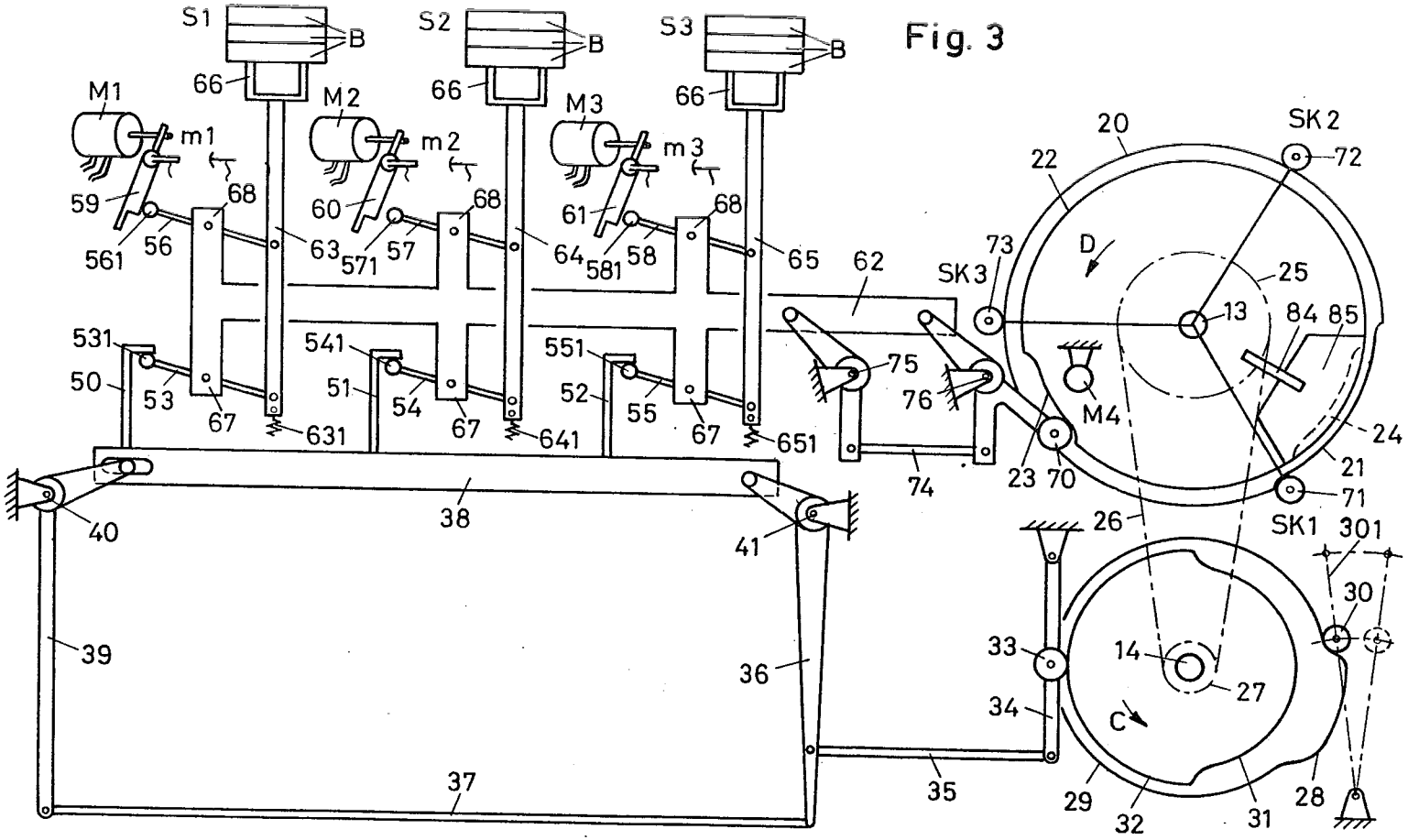
FIG. 3 is a schematic view of chute filling components depicted at time t1 of FIG. 1.
Figure 5:
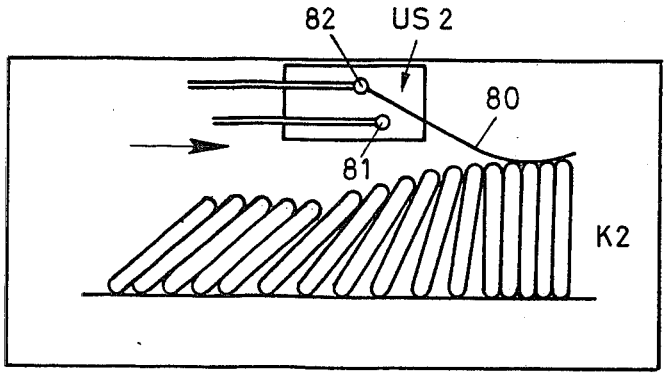
FIG. 5 is a schematic view of a device for monitoring the item supply in a channel, depicted shortly before an undersupply.
Figure 4:
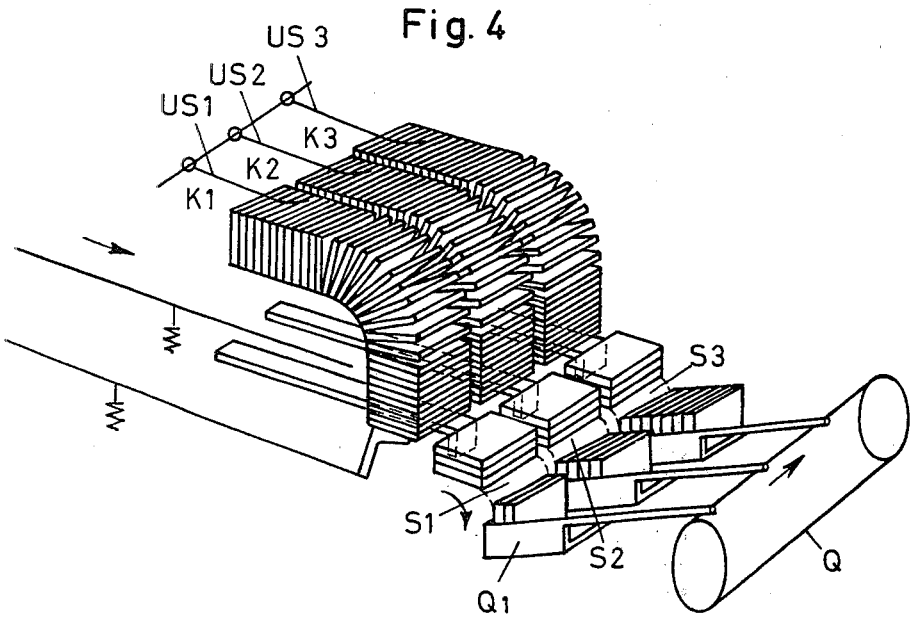
FIG. 4 is a schematic perspective view of a chute charging device depicted at time t1 of FIG. 1.

Turning now to FIG. 3, there are shown schematically the actuating elements for the lowering fingers in the chutes S1, S2 and S3. The individual contacts and solenoids for the control are shown in the circuit diagram of FIG. 13. FIG. 3 shows a mechanism providing for two positions of the lowering fingers 66 as occurring during normal operation when the channels are uniformly filled, as also shown in FIGS. 4 and 5.

As shown in FIG. 3, on a shaft 13 there is mounted a cam disc pair formed of cam discs 20 and 22, whereas on a shaft 14 there is mounted a cam disc pair formed of cam discs 29 and 32. By virtue of an appropriate transmission ratio between sprockets 25 and 27 which are mounted on the respective shafts 13 and 14 and which are connected to one another by a chain 26, the cam discs 29, 32 rotate three times faster than the cam discs 20, 22, since in this example three channels K1, K2 and K3 with the associated three chutes S1, S2 and S3 are present. The contoured peripheries of the cam discs 22, 29 and 32 are engaged by respective follower rollers 70, 30 and 33, while with the cam discs 20 there cooperate three follower rollers 71, 72 and 73 associated with respective three switching contacts SK1, SK2 and SK3.

Figure 10:
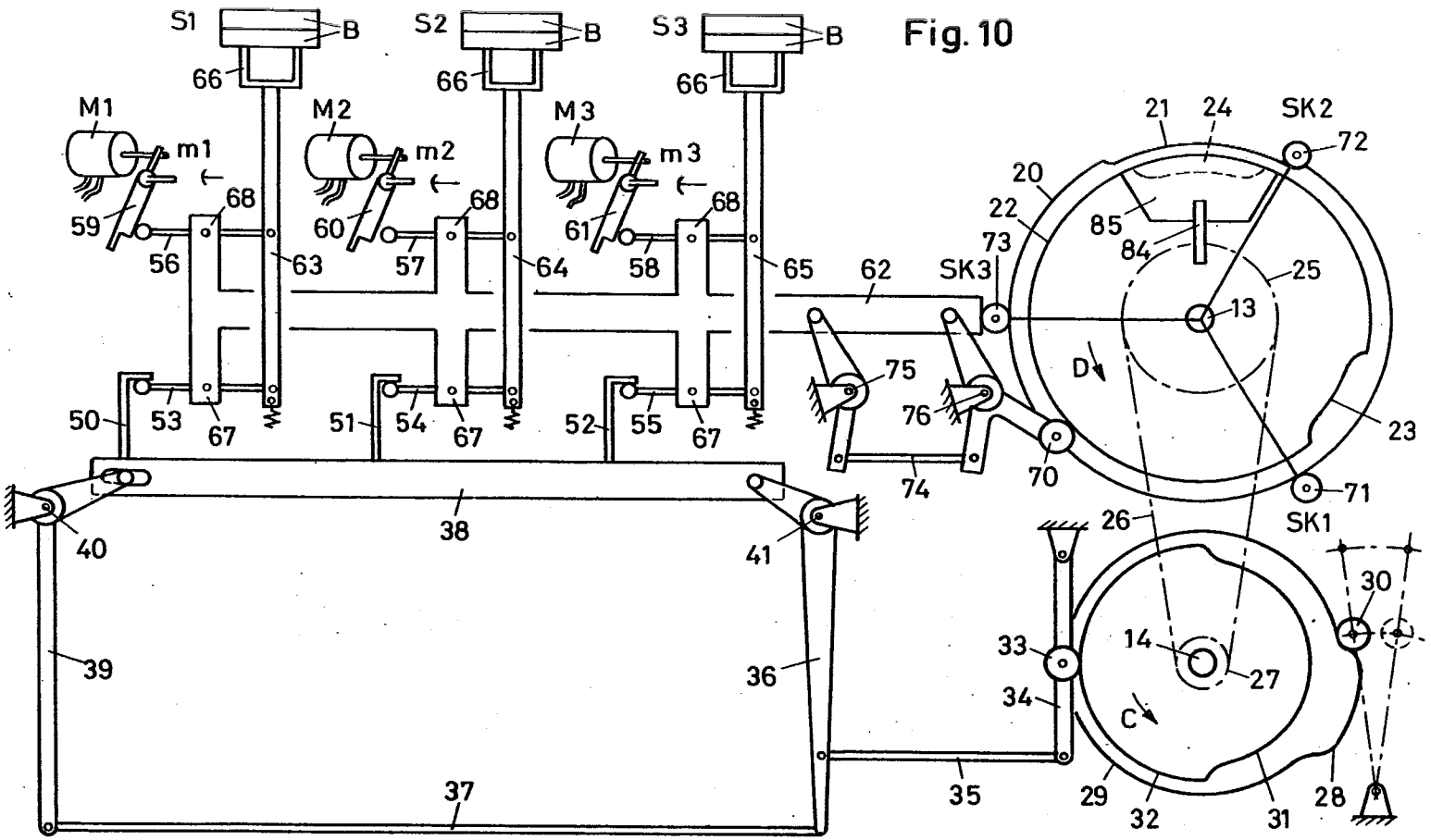
FIG. 10 is a schematic view of chute filling components depicted subsequent to an article equalization at time t8 of FIG. 2B.

A pusher 62 is moved between a lower position as shown in FIG. 3 and an upper position as shown in FIG. 10 by means of a connecting bar 74 which is rotatably supported on two bearings 75, 76 and which carries the follower roller 70 affected by depressions 23 and 24 of the cam disc 22. As will be described later, the depression 24 can be obturated, that is, neutralized. Also reverting to FIG. 1, the pusher 62 is, in its operating sequence, set once for an item stack of three items into its low position and twice for an item stack of three items into its high position. The three switching contacts SK1, SK2 and SK3, whose operative connection with the associated follower rollers is only symbolically shown, monitor the respective channels K1, K2 and K3. Thus, in the position shown in FIG. 3, there is monitored the channel K1 and in the position shown in FIG. 10 there is monitored the channel K2. Between any two such positions, the two cam discs 29 and 32 rotate through one full revolution. As a result, the follower rollers 33 and 30 move once in response to the elevation 28 and the depression 31, respectively. The follower roller 30 serves for driving the pusher 11 with the intermediary of the rod 12 (FIG. 1). The follower roller 33 displaces, with the intermediary of a lever 34 and a connecting rod 35, a parallelogram drive which is formed of a lever 36, a bar 37, a connecting rod 38 and a compensating lever 39. The lever 36 and the compensating lever 39 are pivotally supported in two respective bearings 40, 41 mounted on the machine frame.

The connecting rod 38 serves for the simultaneous upward and downward displacement of supporting bars 50, 51 and 52 associated with a respective lowering finger 66. With the supporting bars 50, 51 and 52 there are connected respective levers 53, 54 and 55 which are articulated to respective arms 67 of the pusher 62 and to the lowering rods 63, 64 and 65 of the lowering fingers 66. The pusher 62 further has additional lateral arms 68 which extend in a direction opposite to that of the respective arms 67. Levers 56, 57, 58 are articulated to respective arms 68 and to respective lowering rods 63, 64, 65. The free end 561, 571 and 581 of the respective levers 56, 57, 58 cooperates with solenoid pawls 59, 60 and 61 which actuate magnetic contacts m1, m2 and m3 and are, in turn, actuated by magnets M1, M2 and M3.

FIGS. 4 through 7 illustrate particular states and arrangements in the process of transferring items to the trays of the conveyor Q.

FIG. 4 shows the state depicted in FIG. 3 in which case three items are taken from each channel. On the conveyor chain Q in the three trays shown there are situated, respectively, two, four and seven items. This condition corresponds, for example, to the condition at the time t3 in FIG. 1. The conveyor chain Q next shifts the groups by one step, whereupon the three ready items in the chutes S1-S3 are transferred to the trays at time t4. By means of the monitoring switches US1, US2 and US3, the fill condition in the respective channels is supervised. A monitoring contact US2 for the channel K2 is schematically illustrated in FIG. 5. Thus, in case of an undersupply, an electric circuit is closed since a feeler finger 80 which, in the presence of articles, is deflected upwardly, drops down if no article is present and closes the contact bridge 81, 82.

Figure 6:
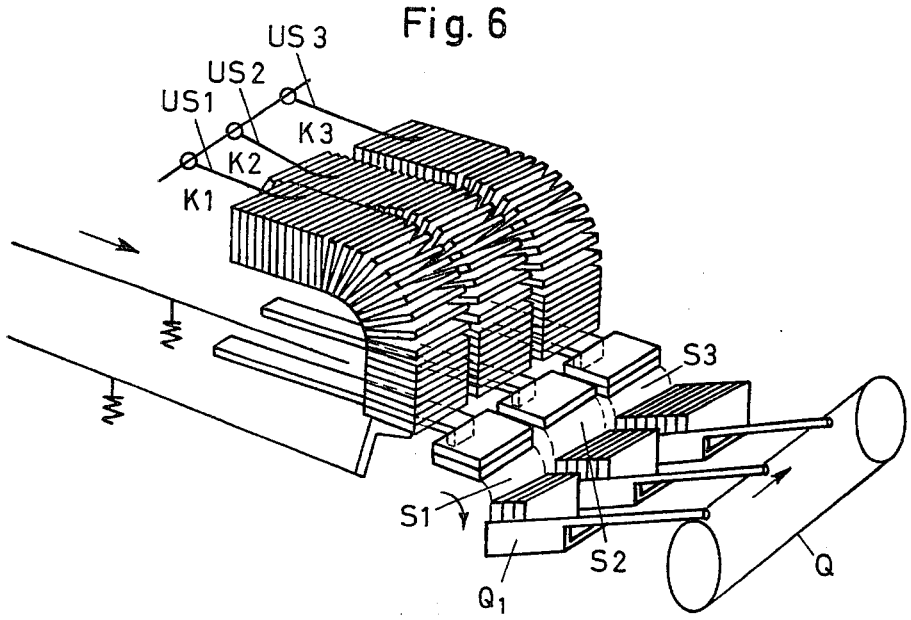
FIG. 6 is a schematic perspective view of a chute charging device depicted during an undersupply of the middle channel at time t2 in FIG. 2B.
Figure 7:
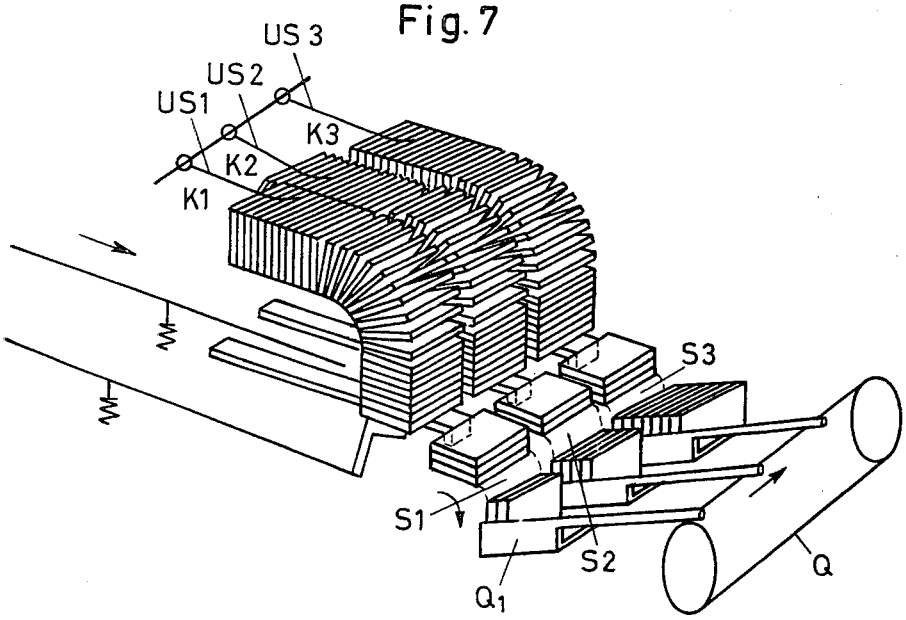
FIG. 7 is a view similar to FIG. 6, depicting the device at time t3 of FIG. 2B.

FIG. 6 depicts the state of the arrangement at time t4 of FIG. 2B, whereas in FIG. 7 there is shown the state of time t5 of FIG. 2B, which is thus the situation when there is an undersupply in the channel K2.

Turning now to FIGS. 11A and 11B, there is shown a mechanism for uncovering (that is, activating) or covering (that is, neutralizing) the depression 24 of the cam disc 22. FIGS. 11A and 11B show the shaft 13, the sprocket 25 and the two cam discs 20 and 22 in a schematic side elevational view. A solenoid M4 is situated behind the cam disc 22, as also seen in FIG. 3. A lever 84 is rotatably supported by a bearing 86 which is fixedly attached to the cam disc 22. To a free end of the lever 84 there is affixed a covering plate 85 by means of which the depression 24 may be obturated. In such a covered (obturated) state the depression 24 is inoperative, since the follower roller 70 will travel on the periphery of the plate 85 instead of dropping into the depression 24. The lever 84 and the covering plate 85 are urged by means of a spring 87 into the obturating position. When the arrangement 84-87 is situated in the zone of the magnet M4 durinng rotation of the cam disc 22, the armature 83, when in the extended position shown in FIG. 11A, presses on the lever 84 overcoming the force of the spring 87, thus lifting the cover plate 85 off the depression 24. As a result, the depression 24 is activated.

Figure 9:
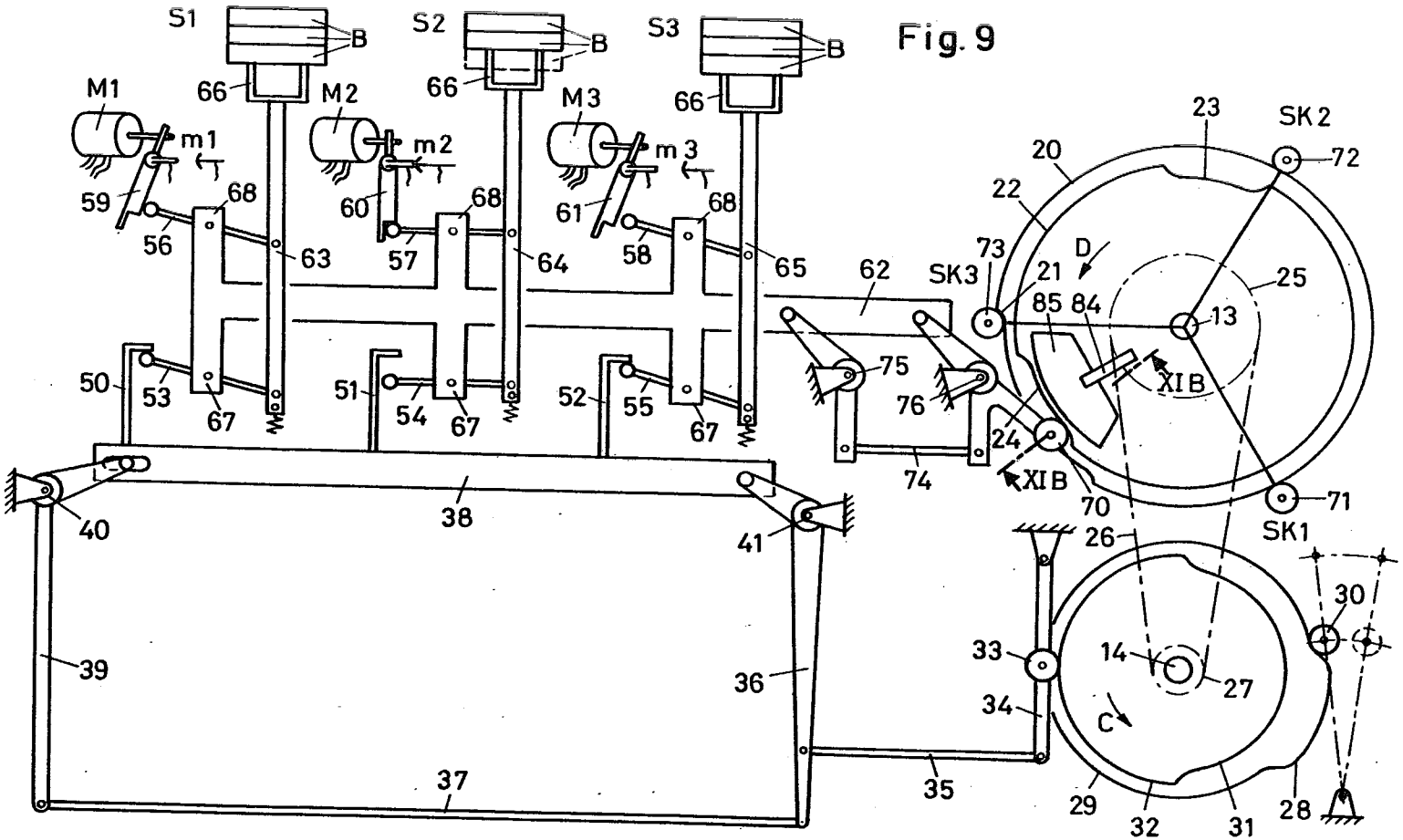
FIG. 9 is a schematic view of chute filling components depicted at time t3 of FIG. 7.

Turning now to FIG. 12, there are shown the three positions of the lowering finger 66, namely a highest position 661 in which only a single item is pushed out of the chute, a mid-position 662 for two items and finally a lowest position 663 for three items. There are further shown the two possible positions of the pusher 62 and, since the chute S2 is depicted in FIG. 12, there are illustrated the lever 57 and the lowering rod 64 associated with that chute as shown in FIG. 9. Also shown are the pusher 11 and the rod 12 for transferring the items from the chute S2 to the trays. If, in accordance with an earlier mentioned variant, only four items are to be brought into the mixed group, the chute walls W are displaced into and immobilized in the dashed position W' and the pusher 11 as well as the rod 12 operate in the new position 11' and 12'.

Turning now to FIG. 13, there is illustrated a circuit diagram for the various switch contacts and solenoids. Each solenoid M1, M2 and M3 is associated with a holding relay F1, F2 and F3, respectively. The solenoid M1, the holding relay F1, the monitoring contact US1 and the switching contact SK1 are connected in series between ground and a voltage U. The solenoids M2 and M3 are similarly arranged with the respective components F2, US2 and SK2 as well as F3, US3 and SK3. The three magnet contacts m1, m2 and m3 are connected parallel to one another and are connected between the voltage U and one terminal of the solenoid M4 whose other terminal is grounded. The holding relays F1–F3 may be, for example, monostable multivibrators.

In the description which follows, the operation of the above-described system will be summarized.

In the state according to FIGS. 3 and 4, the follower roller 71 of the switching contact SK1 is in the depression 21 of the cam disc 20. As a result, the contact SK1 is closed, as shown in FIG. 13. The pusher 62 is in its lower position and the levers 56, 57 and 58 are not in engagement with the associated magnet pawls 59, 60 and 61. The lowering fingers 66 thus are situated in the position 663 (FIG. 12). It is assumed that this takes place at the time t1 (FIG. 2B). It is further assumed that at the same time, the monitoring switch US2 interconnects the contacts 81, 82.

Figure 8:
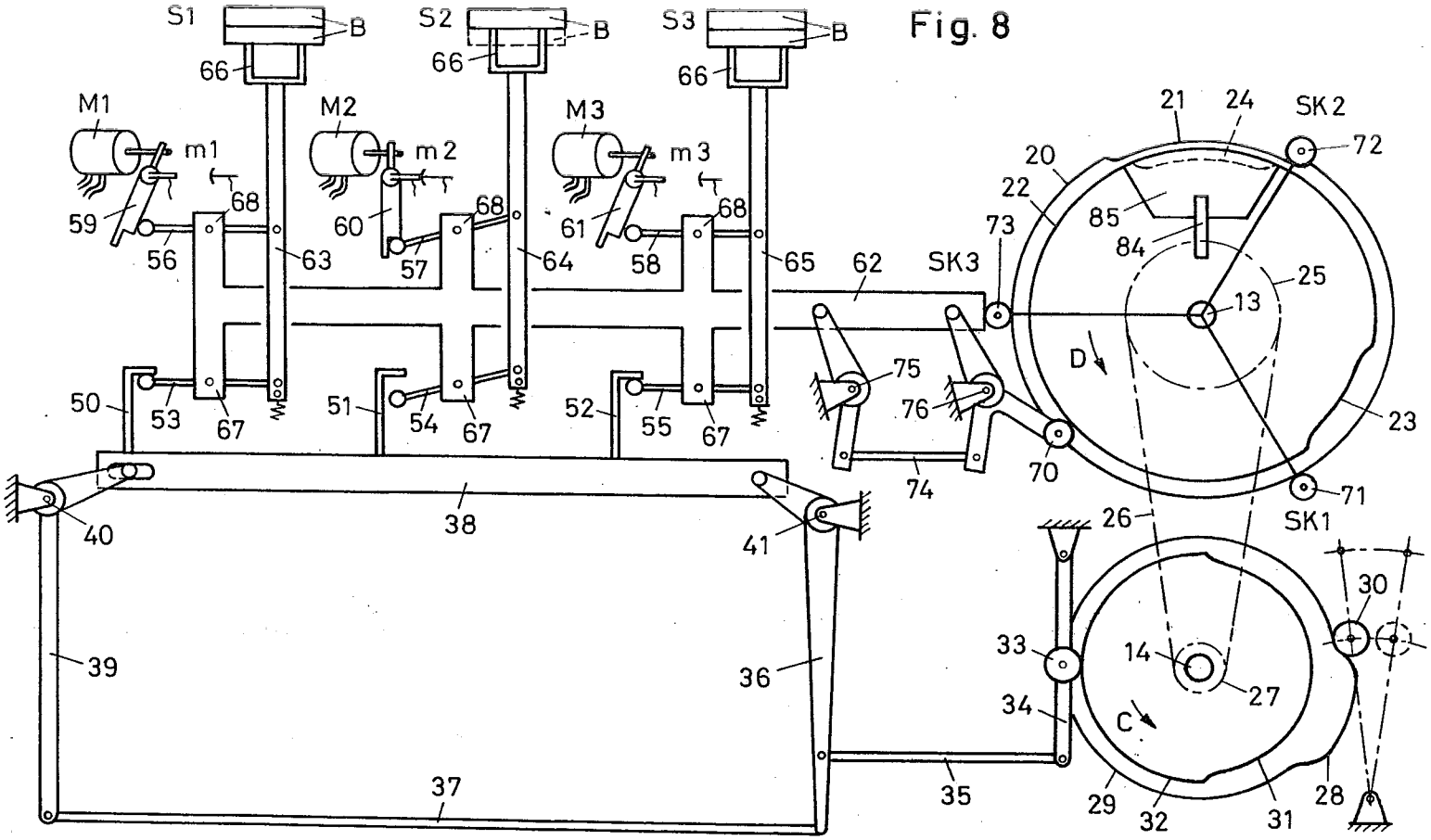
FIG. 8 is a schematic view of chute filling components depicted at time t2 of FIG. 6.

If now, according to FIG. 3, the cam discs 29 and 32 are rotated in the direction of the arrow C through 360° by means of a drive (not illustrated), the cam discs 20 and 22 rotate, as a result of the transmission ratio from the sprocket 27 to the sprocket 25, through an angle of 120° in the direction of the arrow D. The operational sequence is as follows: by virtue of the follower roller 30 riding up on the elevated portion 28 of the cam disc 29, the lever 301 pivots counterclockwise and as a result, the rod 12 coupled thereto moves the pusher 11 which thus pushes three items each from the chutes S1, S2 and S3. Thereafter, the follower roller 33 drops into the depression 31 of the cam disc 32 and thus the holding rods 50, 51 and 52 are lowered together with the lever ends 531, 541 and 551. The follower roller 70 leaves the depression 23 and thus the pusher 62 is brought into its upper position whereas the end pieces 561, 571 and 581 of the levers 56, 57 and 58 are brought into the lower position. The depression 21 thus closes the switching contact SK2 so that the solenoid M2 - since the monitoring switch US2 is already close - is energized and thus brings the magnet pawl 60 into the position shown in FIG. 8. As the follower roller 33 rides on the elevated portion of the cam disc 32, the holding rods 50, 51 and 52 are brought into their upper position and the tension springs 631, 641 and 651 ensure that the lowering fingers 66 with the rod 63, 64 and 65 assume their lowermost possible position. This lowermost possible position is, at time t2 of FIG. 2B, 662 for the lowering fingers 66 associated with the chutes S1 and S3 and 661 for the lowering finger 66 associated with the chute S2. Thus, at time t2 only one item is delivered from the chute S2 while in the chutes S1 and S3, corresponding to the position 662 of the lowering fingers, two items are delivered. At time t3 of FIG. 2B, in the chutes S1 and S3 there has to be delivered three items each and in the chute S2 there has to be delivered two items.

As the solenoid M2 is energized, its contact m2 also closes and thus the solenoid M4 is energized. This means that, since the cam disc 22 is in a position according to FIG. 9, the depression 24 is uncovered (activated) and the follower roller 70 is thus capable of dropping into the depression 24. As a result, the pusher 62 and thus the lowering finger 66 is lowered into the position 663. Since, however, the holding relay F2 retains information for an entire cycle, that is, for a 360°-rotation of the shaft 13, the solenoid M2 remains energized and the lever 57 is in engagement with the magnet pawl 60, so that the position 662 will result.

It is to be understood that the above-described sequences also occur in case of an undersupply in channels K1 or K3. For the purpose of simplification of the explanations, a system with only three channels has been shown. It is to be understood, however, that the system may operate with a great number of channels which may extend side-by-side to a width of, for example, one meter.

The switching contacts SK1, SK2, SK3 activated at different time intervalls by cam disc 20 and the holding relays F1, F2, F3 act as memory means for the signals from monitoring switches US1, US2 and US3 respectively.

With an undersupply in one channel K1, K2, K3 a signal given at an arbitrary moment by one of said associated monitoring switches US1, US2, US3 is retained by said memory means for energizing one or more of the solenoids M1, M2, M3, N4 at a later time for the mechanical means may take up the respective number of items in a way as described above.

It will be understood that the above description of the present invention is susceptible to various modifications, changes and adaptations, and the same are intended to be comprehended within the meaning and range of equivalents of the appended claims.

What is claimed is:

1. In a method of grouping flat items in stacks, including the steps of advancing the items on at least three parallel channels to a grouping device; cyclically transferring a predetermined number of items from each channel to said grouping device; and forming mixed groups by the grouping device such that each mixed group contains at least one item from each said channel; the improvement comprising the following steps:

(a) monitoring each channel for determining an undersupply of items therein;

(b) upon determination of an undersupply in a channel and for a duration following said determination, transferring from the undersupplied channel to said grouping device a number of items which is reduced by a first quantity as compared with the quantities transferred from the undersupplied channel when there is a normal supply of articles therein; and (c) upon determination of an undersupply in a channel and for a period following said determination, transferring from the normally supplied channels to said grouping device a number of items which is increased by a second quantity as compared with the quantities transferred by the normally supplied channels when all the channels are normally supplied, whereby the number of the items in the mixed groups obtained by the cyclical transfer of articles from said channels remains constant.

2. A method as defined in claim 1, wherein step (b) includes the step of transferring from the undersupplied channels the reduced item quantities in at least as many cadences as the number of the remaining normally supplied channels.

3. In an apparatus for grouping flat items in stacks, including at least three parallel channels on which the items are advanced; a grouping device including carrier means and transfer means for cyclically transferring a predetermined number of items from each channel to said carrier means during normal supply of the channels with items, whereby each completed group stack contains at least one item from each channel; the improvement wherein said grouping device comprises (a) monitoring means for responding to an undersupply of items in any of said channels; and (b) quantity varying means operatively coupled to said monitoring means for reducing by a first quantity said predetermined number of items transferred from an undersupplied channel to said carrier means in each cycle for a predetermined period from the beginning of response of said monitoring means and for increasing by a second quantity said predetermined number of items transferred from the remaining normally supplied channels to said carrier means in each cycle for a predetermined period from the beginning of response of said monitoring means whereby the number of items in each completed group stack remains constant.

4. An apparatus as defined in claim 3, wherein said monitoring means comprises an item sensing device having (a) a sensor arm supported in the path of the items in each said channel; each sensor arm having a first position indicating presence of items and a second position indicating absence of items; and (b) an electric circuit means operatively coupled to said quantity varying means and including contact means cooperating with each sensor arm for opening said electric circuit means in one of said positions of each sensor arm and for closing said electric circuit means in the other of said positions of each sensor arm.

5. An apparatus as defined in claim 3, wherein said monitoring means includes an electric circuit means operatively coupled to said quantity varying means and having an open and a closed state dependent upon a normal supply or an undersupply of articles in any of said channels; said electric circuit means including memory means for maintaining the electric circuit means in a state it assumed in response to an undersupply in any of said channels, for a period corresponding to an entire cycle of said grouping device.

6. An apparatus as defined in claim 5, further comprising a cyclically driven drive means connecting said memory means with said transfer means.

7. An apparatus as defined in claim 3, further comprising setting means for setting said transfer means in each said channel for selectively transferring a third, fourth and fifth quantity to said carrier means; said third quantity being predetermined for a normal supply of items in all said channels; said fourth quantity being said third quantity decreased by said first quantity and said fifth quantity being said third quantity increased by said second quantity.

* * * * *